US012123276B2

(12) United States Patent
Ewing et al.

(10) Patent No.: US 12,123,276 B2
(45) Date of Patent: Oct. 22, 2024

(54) BOREHOLE SEALING WITH TEMPERATURE CONTROL, METHOD, AND SYSTEM

(71) Applicant: Baker Hughes Oilfield Operations LLC, Houston, TX (US)

(72) Inventors: Daniel Ewing, Katy, TX (US); Guijun Deng, The Woodlands, TX (US); Anil Sadana, Houston, TX (US); Anton Kovalchuk, Houston, TX (US); Ping Duan, Cypress, TX (US); Jason Harper, Cypress, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/964,859

(22) Filed: Oct. 12, 2022

(65) Prior Publication Data

US 2024/0125197 A1 Apr. 18, 2024

(51) Int. Cl.

| | |
|---|---|
| ***E21B 33/12*** | (2006.01) |
| ***E21B 36/00*** | (2006.01) |
| ***E21B 36/04*** | (2006.01) |

(52) U.S. Cl.

CPC ..... *E21B 33/12* (2013.01); *E21B 36/001* (2013.01); *E21B 36/04* (2013.01)

(58) Field of Classification Search

CPC ..... E21B 33/12; E21B 36/001; E21B 36/04

See application file for complete search history.

(56) References Cited

U.S. PATENT DOCUMENTS

| | | | | |
|---|---|---|---|---|
| 3,053,321 | A * | 9/1962 | Ortloff | E21B 33/128 166/60 |
| 5,168,929 | A * | 12/1992 | Galloway | E21B 37/04 166/170 |
| 6,926,949 | B1 * | 8/2005 | Halg | C09J 175/16 428/192 |
| 7,234,533 | B2 * | 6/2007 | Gambier | E21B 33/1277 166/207 |

(Continued)

FOREIGN PATENT DOCUMENTS

| | | |
|---|---|---|
| CN | 109594972 A | 4/2019 |
| CN | 111323084 A | 6/2020 |

(Continued)

OTHER PUBLICATIONS

Notification of Transmittal of the International Search Report and the Written Opinion of the International Searching Authority, or the Declaration; PCT/US2023/076567; mail date: Jan. 22, 2024; 10 pages.

(Continued)

*Primary Examiner* — Steven A MacDonald

(74) *Attorney, Agent, or Firm* — CANTOR COLBURN LLP

(57) ABSTRACT

A method for improving sealing in boreholes includes temperature controlling seals to maintain sealing loading by managing temperature of the seal to a target temperature range. A borehole system includes a borehole in a subsurface formation, a string in the borehole, a seal tool in contact with the string and temperature controller within or in thermal proximity to the seal.

10 Claims, 13 Drawing Sheets

(56) References Cited

U.S. PATENT DOCUMENTS

| | | | | |
|---|---|---|---|---|
| 8,684,100 | B2 * | 4/2014 | Tingler | E21B 23/06 166/387 |
| 9,181,771 | B2 * | 11/2015 | Corre | E21B 33/127 |
| 9,567,821 | B2 * | 2/2017 | Bramwell | E21B 33/1208 |
| 2002/0121372 | A1 | 9/2002 | Cook et al. | |
| 2002/0157831 | A1 | 10/2002 | Kurlenya et al. | |
| 2005/0161212 | A1 * | 7/2005 | Leismer | E21B 33/00 166/179 |
| 2009/0151957 | A1 * | 6/2009 | Sickle | E21B 43/14 166/381 |
| 2011/0272150 | A1 * | 11/2011 | Ives | E21B 49/10 166/264 |
| 2014/0209302 | A1 * | 7/2014 | Kristensen | E21B 33/12 166/57 |
| 2015/0176362 | A1 | 6/2015 | Prieto et al. | |
| 2016/0216009 | A1 | 7/2016 | Chen et al. | |
| 2018/0112779 | A1 | 4/2018 | Nahrwold et al. | |

FOREIGN PATENT DOCUMENTS

| | | | | |
|---|---|---|---|---|
| JP | 2019087753 | | 6/2019 | |
| WO | WO-2009022134 | A1 * | 2/2009 | E21B 33/08 |
| WO | WO-2010127240 | A1 * | 11/2010 | E21B 23/06 |
| WO | 2014166688 | A1 | 10/2014 | |
| WO | 2019072337 | A1 | 4/2019 | |

OTHER PUBLICATIONS

International Search Report and Written Opinion; PCT/US2023/076562; Korean Intellectual Property Office; mailed Feb. 6, 2024; 10 pages.

International Search Report and Written Opinion; PCT/US2023/076565; Korean Intellectual Property Office; Mailed Jan. 30, 2024; 9 pages.

* cited by examiner

BOREHOLE SEALING WITH TEMPERATURE CONTROL, METHOD, AND SYSTEM

BACKGROUND

In the resource recovery and fluid sequestration industries, it is difficult to maintain a steady state thermal condition. This is due to fluids being pumped into and out of a borehole into a subsurface formation. Fluid exchange will cause changes in the borehole temperature over time. In order for seals to work properly, they are designed with temperature ranges over which they perform laudably. The greater the range of temperature applicability for a seal, the greater the cost for the seal. Reduction of cost while increasing reliability over a broader temperature range is always a strong goal of the industry.

SUMMARY

A method for improving sealing in boreholes includes temperature controlling seals to maintain sealing loading by managing temperature of the seal to a target temperature range.

A borehole system includes a borehole in a subsurface formation, a string in the borehole, a seal tool in contact with the string, and a temperature controller within or in thermal proximity to the seal.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

The inventors hereof have determined that maintaining seals within a preferred operating range with regard to temperature can dramatically improve the sealing performance obtained. This can be accomplished by supplying a temperature controller in thermal communication with the seal. The temperature controller may be a heater or a cooler and in some cases may be either in the same device depending upon input. For example, a thermoelectric device may be used as a cooler with a first polarity and as a heater with a reversed polarity. Alternatively, a Ranque-Hilsch vortex tube may be used as a heater or a cooler depending upon which exit flow is used on the target component. The temperature controllers as disclosed herein comprise both discrete heaters and coolers that are in thermal communication or comprise the seal material itself with doping in all of or in a part of the seal material. The doping contemplated comprises materials in the seal that respond to inputs to create the temperature changes desired. It is to be understood that for all embodiments requiring the application of an electrical current, that current may be supplied locally or may be supplied from a more distant source such as from the surface from which a borehole extends.

Figure 1:
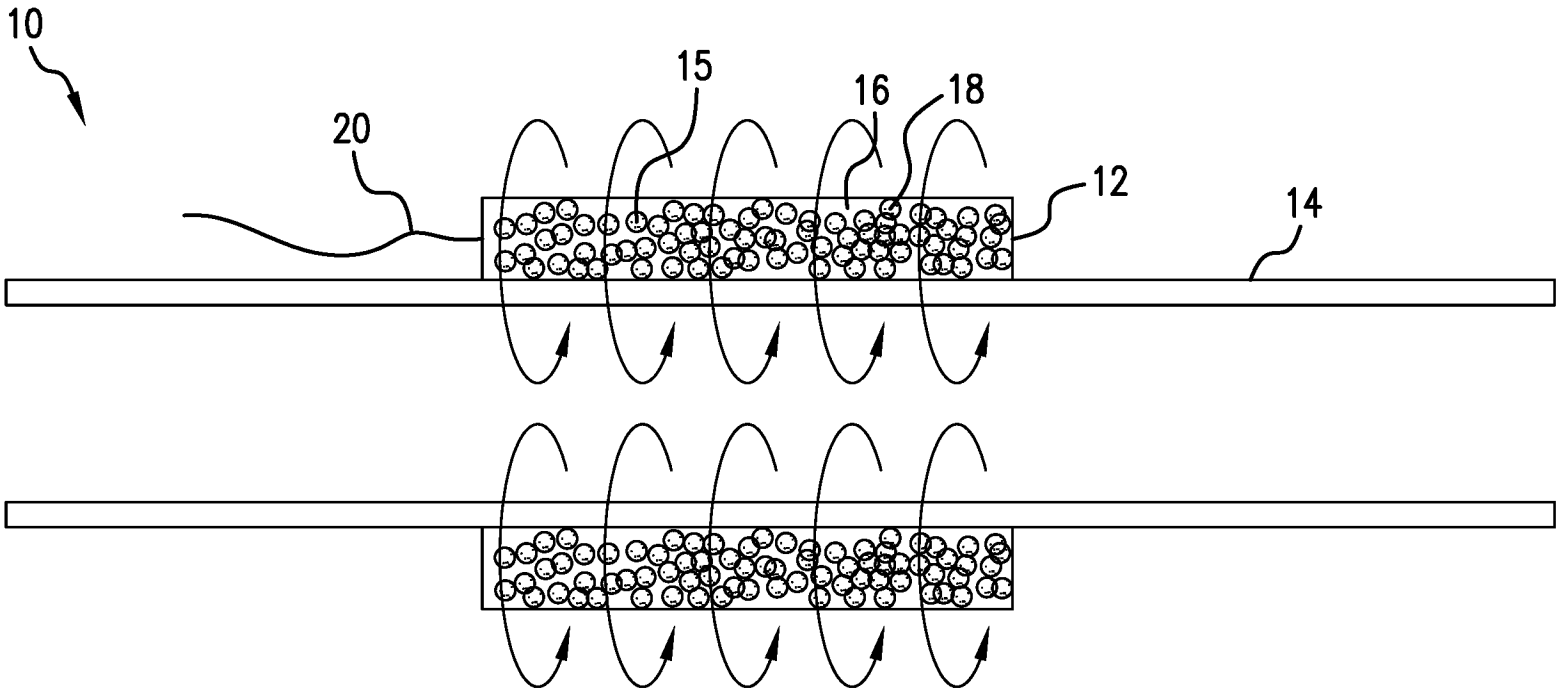
FIG. 1 is a schematic view of a seal tool with a temperature control material in thermal communication therewith.

Referring to FIG. 1, a seal tool 10 comprises seal 12 such as a packer disposed upon a mandrel 14. The seal 12 comprises a seal material 16 that is primarily of a commonly known type such as rubber, thermoplastic, swell rubber, shape memory material, etc. but also comprises one or more dopants 18 to ensure that the seal material 16 will be at least magnetically permeable and/or electrically conductive and in embodiments will also be thermally conductive. In these embodiments the temperature control material 15 is actually the doped seal material 16 itself. Different doping based embodiments are illustrated collectively in FIG. 1 where the stipple pattern is intended to be dopant of the various types noted below. In other embodiments discussed in connection with other figures hereinbelow, the temperature controller may be a separate material or even device that is in thermal communication with the seal 12. Still referring to FIG. 1, one or more of the dopants discussed may be incorporated in the seal material 16. Magnetic conductivity is promoted by the inclusion of iron, cobalt, nickel, magnetite, ferrite or other materials known to exhibit magnetic permeability. Doping of magnetically permeable material may be in a range of from about 10 weight percent to about 60 weight percent of the total weight of the seal material 16. For electrical conductivity, dopants such as carbon black, carbon fiber, graphite, carbon nanotubes, copper powder, aluminum powder or steel powder or other materials known to exhibit electrical conductivity may be used. Weight percentages of these components may be from 0.5 weight percent to 15 weight percent in various embodiments. To enhance thermal conductivity, dopants such as glass fiber, silica, silicon carbide, boron nitride and alumina or other materials known to exhibit thermal conductivity may be used in ranges of 5 weight percent to 30 weight percent of the total weight of the seal material. Electrically conductive dopants or fillers such as carbon black or graphite can improve thermal conductivity of a sealing material as well. It is to be appreciated that some combinations of dopants may have competing effects. For example, while glass fiber and other inorganics will increase thermal conductivity, they will undermine magnetic permeability. Hence for various operational cases, the desired effect from adding a particular dopant must be balanced against the overall effects that are being targeted.

With the material 16 of the seal 12, or some portion thereof, doped (temperature control material) 15 and configured in a way that at least the portion that is doped, if not the entire element of the seal, is electrically insulated from surrounding conductive material, the doped portion can act as an inductor (electrical conductivity also desirable to support eddy currents that generate heat) or can act as a resistor. FIG. 1 schematically represents both of these embodiments. Accordingly, in these embodiments, the portion itself will respond to an electric current by generating inductive heating or resistive heating, respectively. Where there is also a thermally conductive condition in the seal material 16 (due to a thermally conductive dopant added thereto or due to the material 16 simply being inherently thermally conductive), that heat will propagate throughout the seal 12. Such embodiments can maintain a seal 12 of seal tool 10 in a proper temperature range even in the face of operations such as injection of cooling fluid into the borehole and flowing the seal tool 10.

For an inductive heating embodiment, an alternating current is supplied to the seal 12 through, for example, a conductor 20. Due to the magnetic permeability and eddy currents that form in the material 15 of this embodiment of seal 12, Joule heating of the seal 12 occurs. If iron is one of the doping materials, hysteresis losses may also provide a heating effect in the seal material 12.

Figure 2:
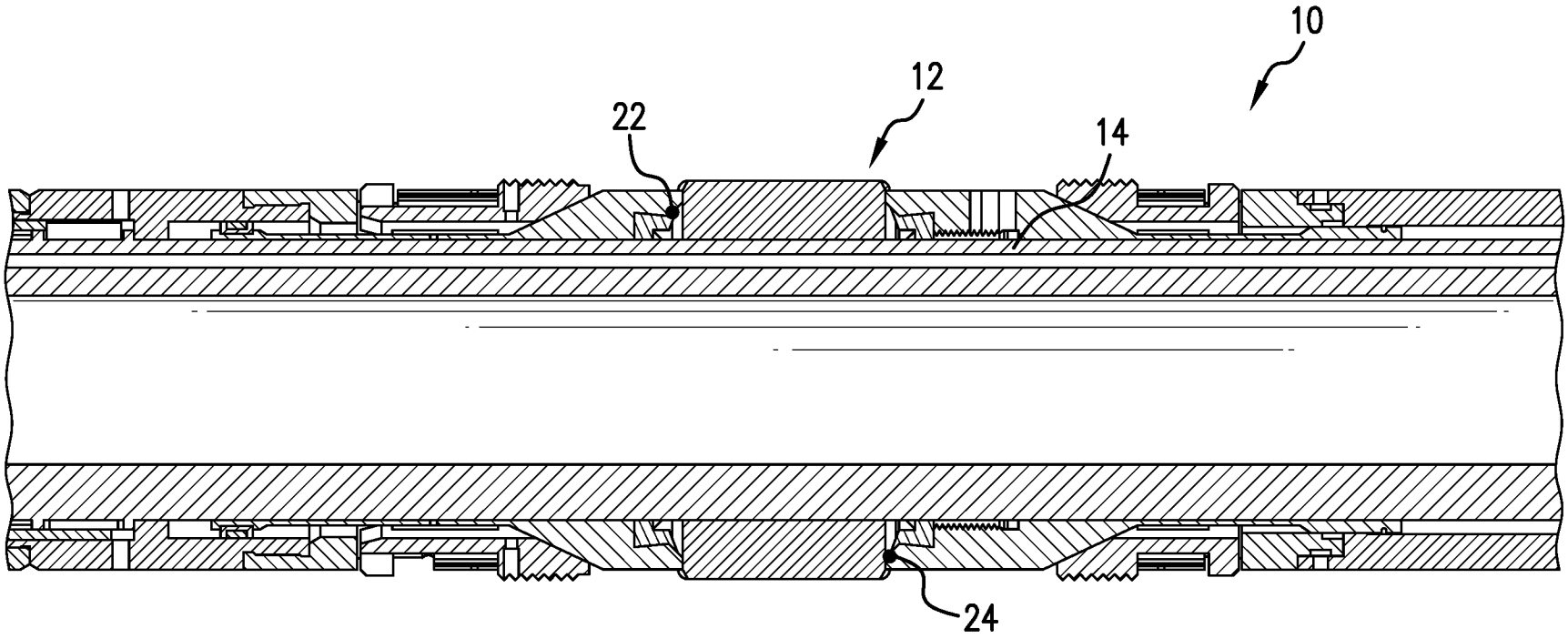
FIG. 2 is a schematic view of a seal tool with another embodiment of a temperature control material in thermal communication therewith.

For a resistive heating embodiment, illustrated in FIG. 2, there needn't be magnetically permeable dopant but rather only electrically conductive dopant 18 need be included. Thermally conductive dopants 18 may also be included in some resistive embodiments. To heat the seal 12, a current is supplied to the seal 12 through power terminals 22 and 24. Current flowing through the seal material 16 that is sufficiently doped with material 15 finds both electrical conductivity and resistance to flow consequently causing the generation of heat. This heat will naturally propagate through the seal 12 but will do so more quickly and evenly in the event the particular embodiment includes thermally conductive dopants as well.

Figure 3:
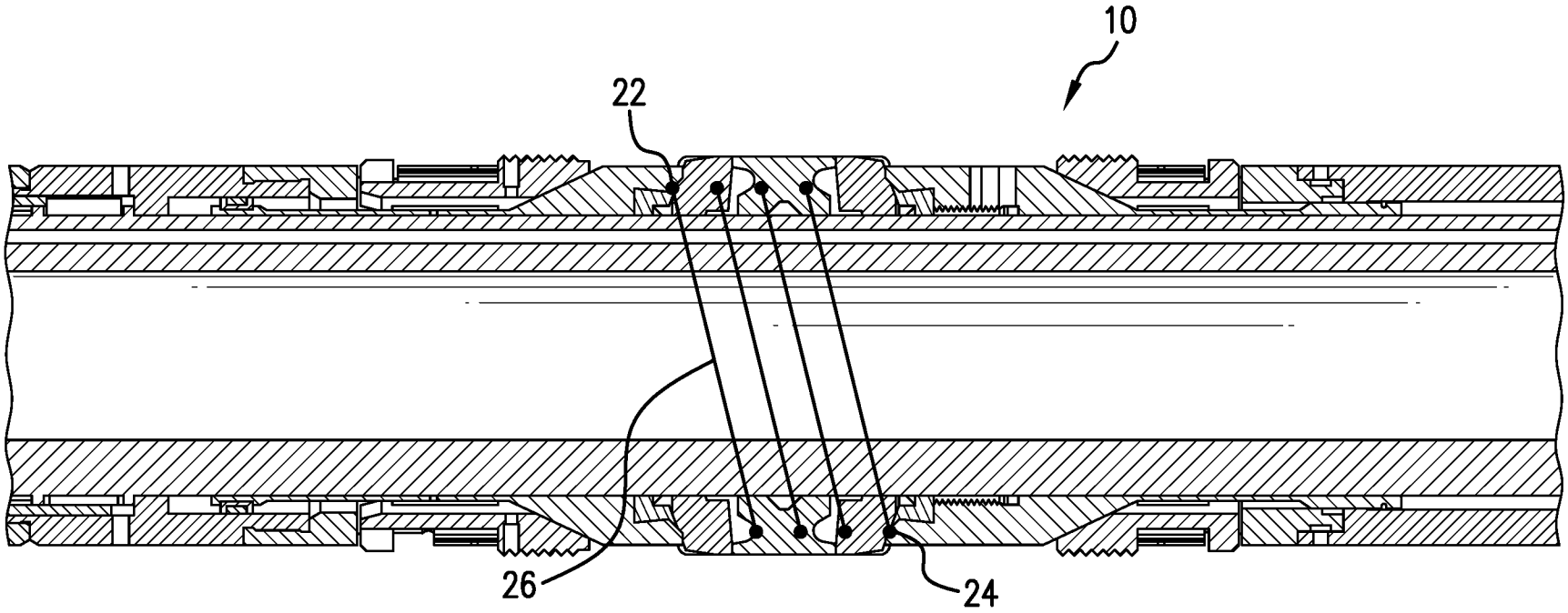
FIG. 3 is a schematic view of a seal tool with another embodiment of a temperature control material in thermal communication therewith.
Figure 4:
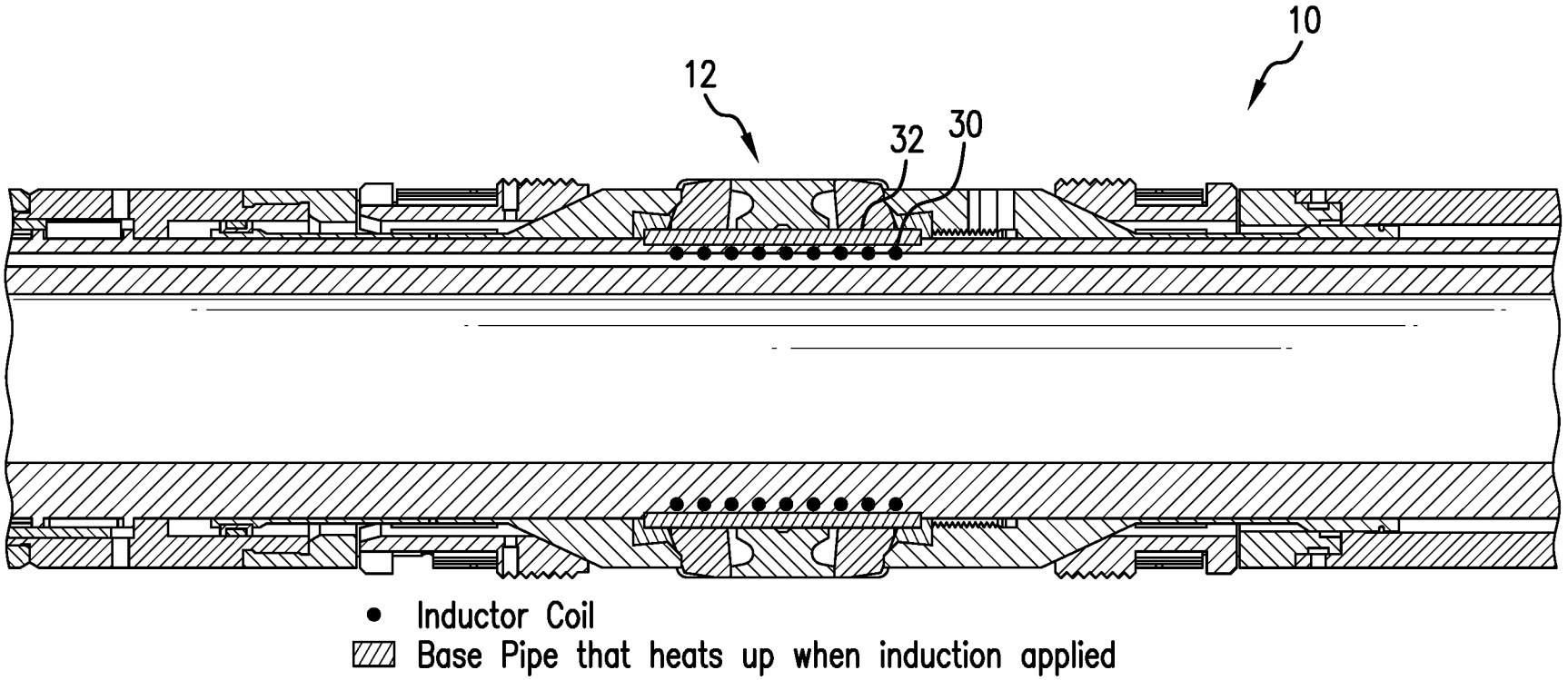
FIG. 4 is a schematic view of a seal tool with another embodiment of a temperature control material in thermal communication therewith.
Figure 5:
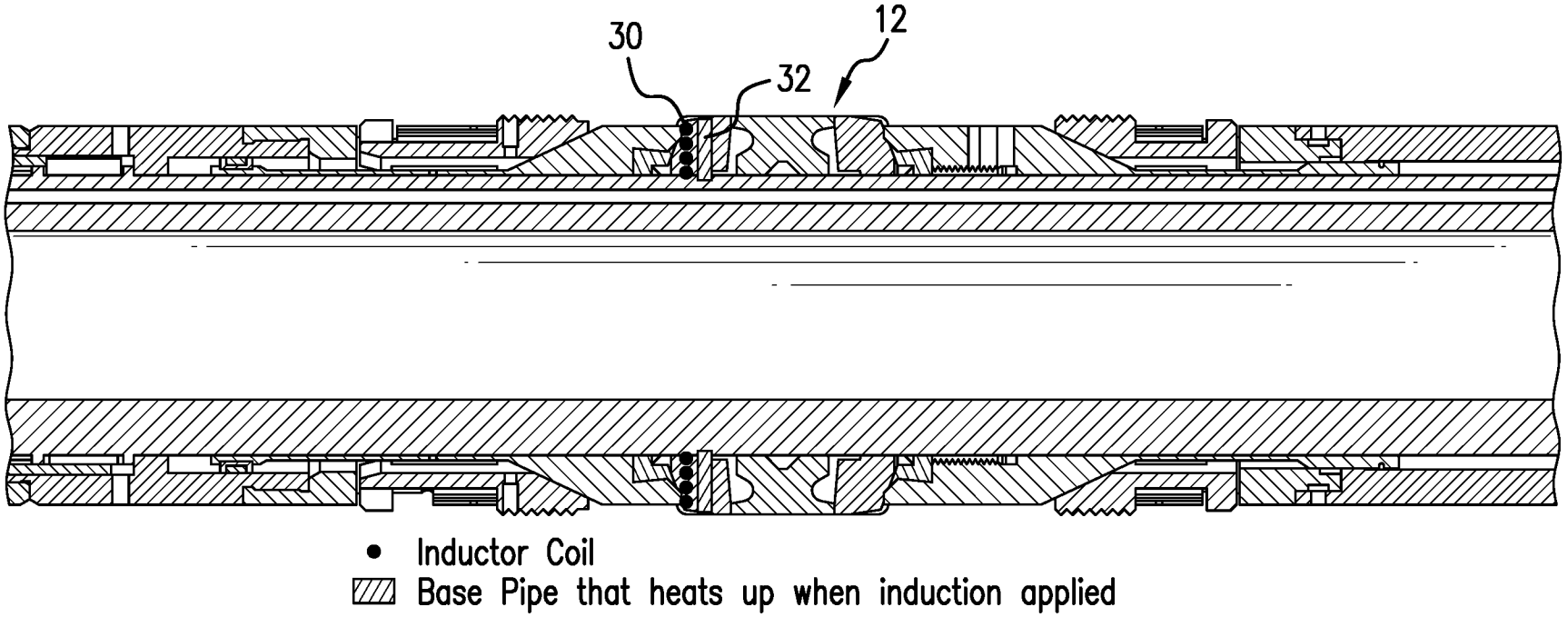
FIG. 5 is a schematic view of a seal tool with another embodiment of a temperature control material in thermal communication therewith.
Figure 6:
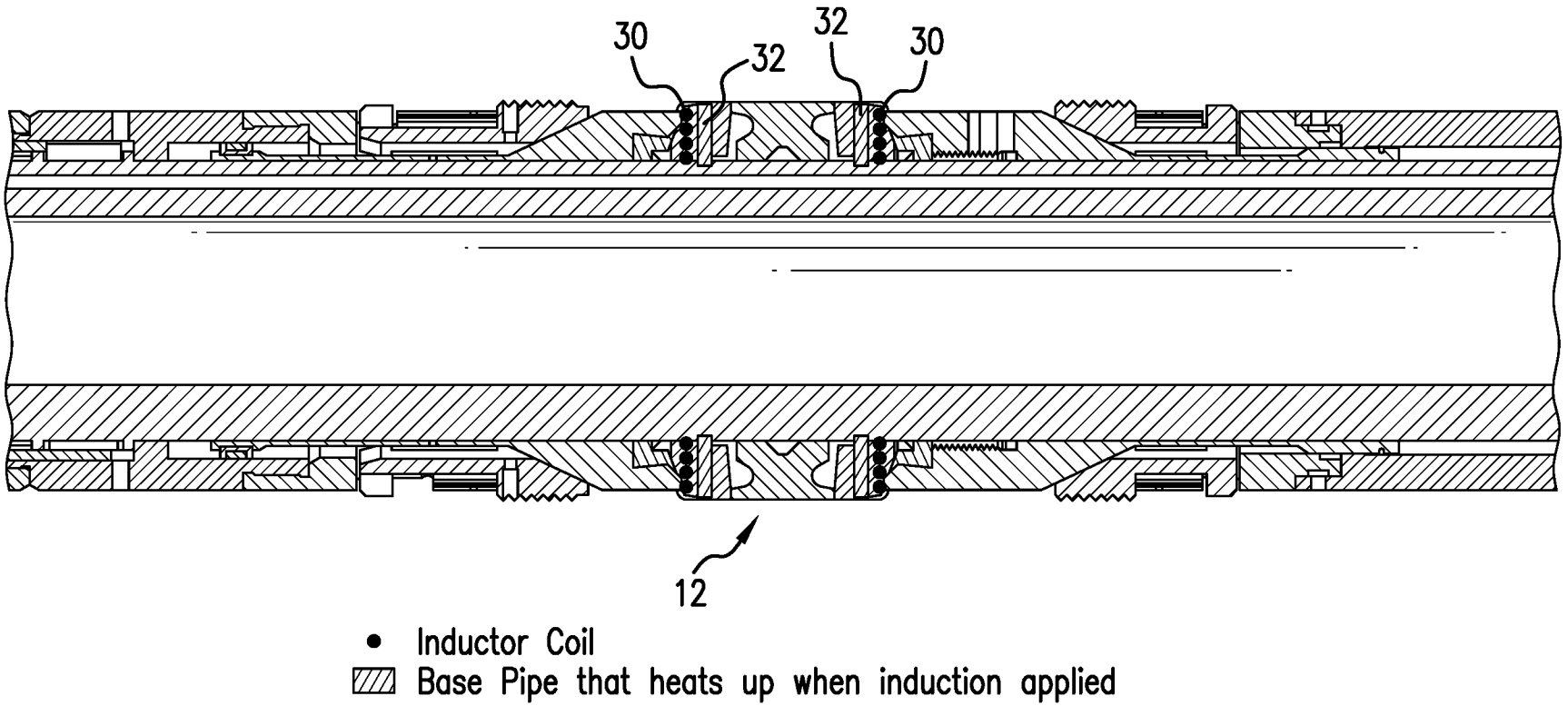
FIG. 6 is a schematic view of a seal tool with another embodiment of a temperature control material in thermal communication therewith.
Figure 7:
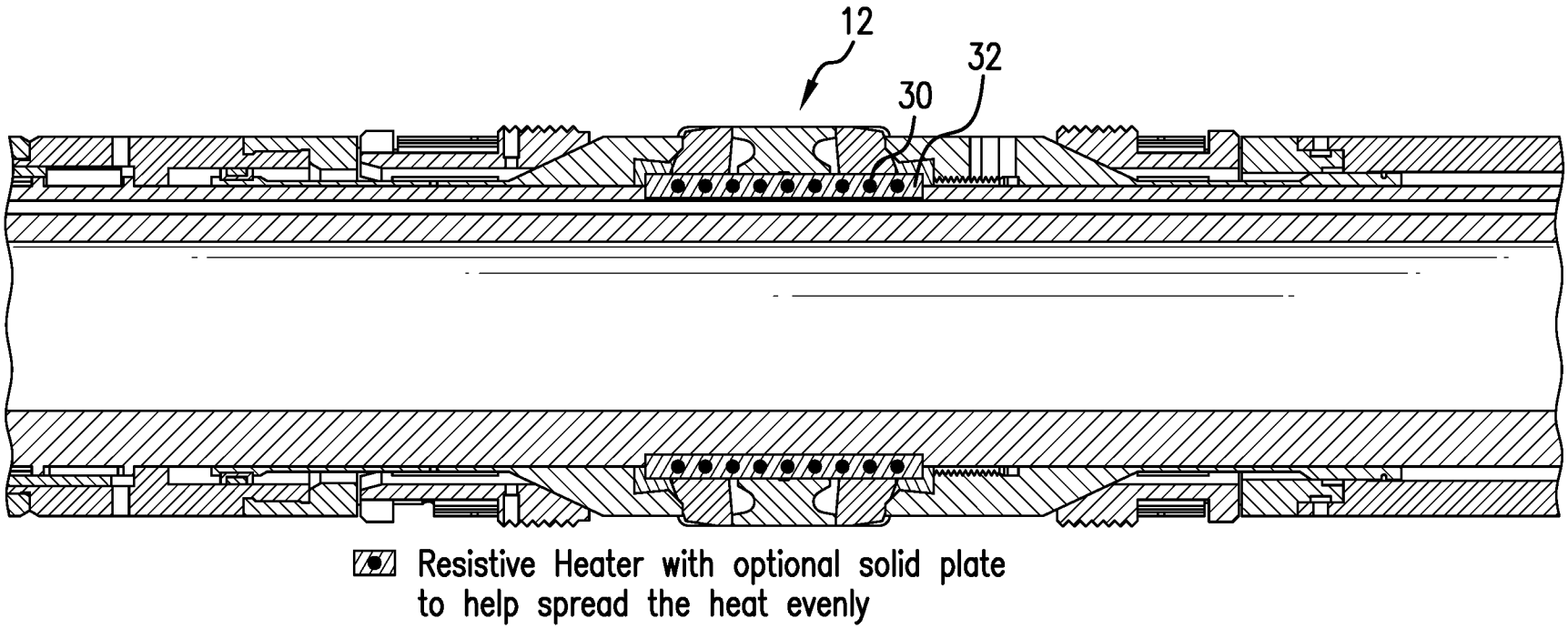
FIG. 7 is a schematic view of a seal tool with another embodiment of a temperature control material in thermal communication therewith.
Figure 8:
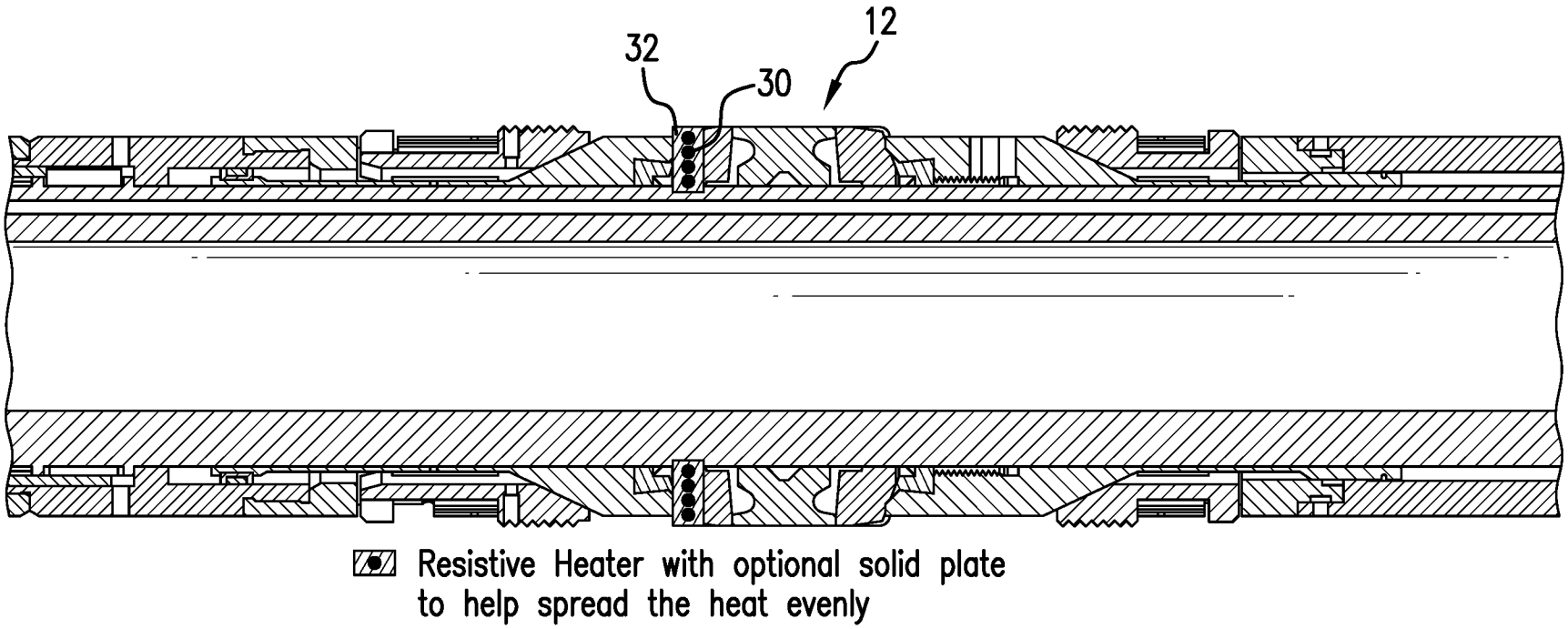
FIG. 8 is a schematic view of a seal tool with another embodiment of a temperature control material in thermal communication therewith.
Figure 9:
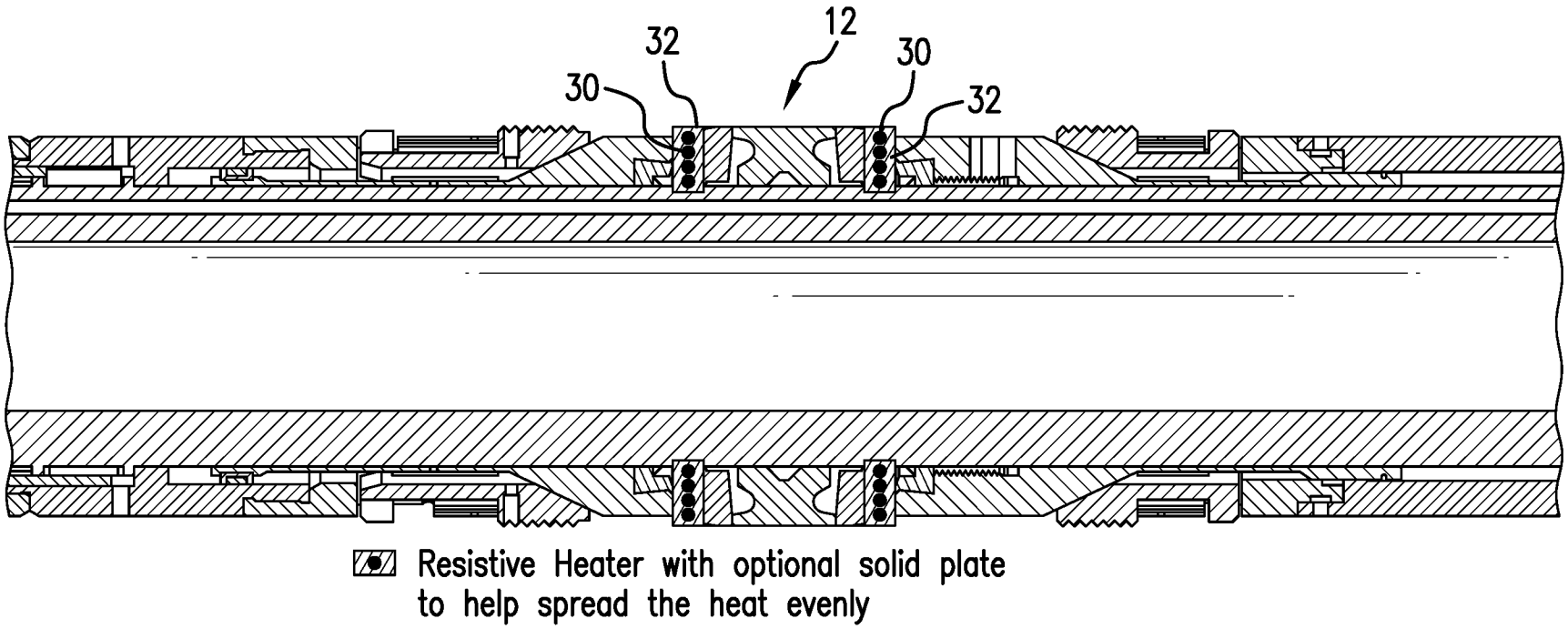
FIG. 9 is a schematic view of a seal tool with another embodiment of a temperature control material in thermal communication therewith.

Referring to FIG. 3, another alternate embodiment is disclosed. In this embodiment, the seal material 16 need not contain magnetically permeable or electrically conductive dopants but may still contain thermally conductive dopants 18. The embodiment does contain a temperature controller 30 comprising an internal resistance wire 26. The wire 26 may be embedded in the seal material 16. Power terminals 22 and 24 are included to supply the current pathway through the wire 26.

In other embodiments, a coil may be disposed adjacent the seal material 16. FIGS. 4-9 illustrate variations on the placement thereof and it is to be appreciated that each of the coil elements depicted may be a resistor or may be an inductor. The drawings are meant to be generic to both. For generic purpose, temperature controller 30 is a discreet unit. Controller 30 is included in each of FIGS. 4-9 but in different positions or as a plurality of controllers 30. There may also be a plate 32 that acts as a thermally conductive spreader located adjacent the controllers 30 or within which the controllers 30 are disposed. The plate 32 may be of a metallic material or could be another material, but in any event is thermally conductive. In each case, the application of current to the controller 30 will produce heat by resistance (direct current or alternating current) or through induction (alternating current) heating or hysteresis heating. That heat is spread either naturally through the seal 12 or with assistance from a plate 32 and/or from a thermally conductive dopant in the seal.

Figure 10:
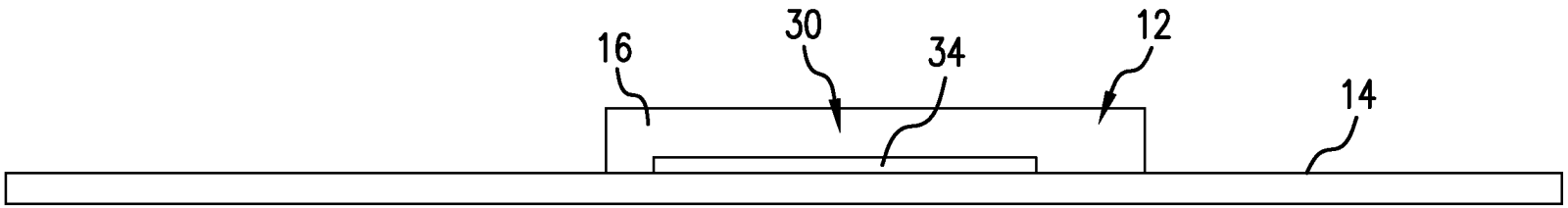
FIG. 10 is a schematic view of a seal tool with another embodiment of a temperature control material in thermal communication therewith.

Referring to FIG. 10, another embodiment of a seal tool 10 with a temperature controller 30 is illustrated. In this embodiment, the controller 30 is adjacent or embedded within the seal material 16 and constitutes its own device. The device is a thermoelectric device 34 such as a Peltier device, and hence may be caused to produce or remove heat at will based upon polarity of current supplied thereto. This embodiment can heat or cool the seal 12 depending upon what is needed to ensure that the seal stays within a preferred temperature range to enhance its sealing capability.

Figure 11:
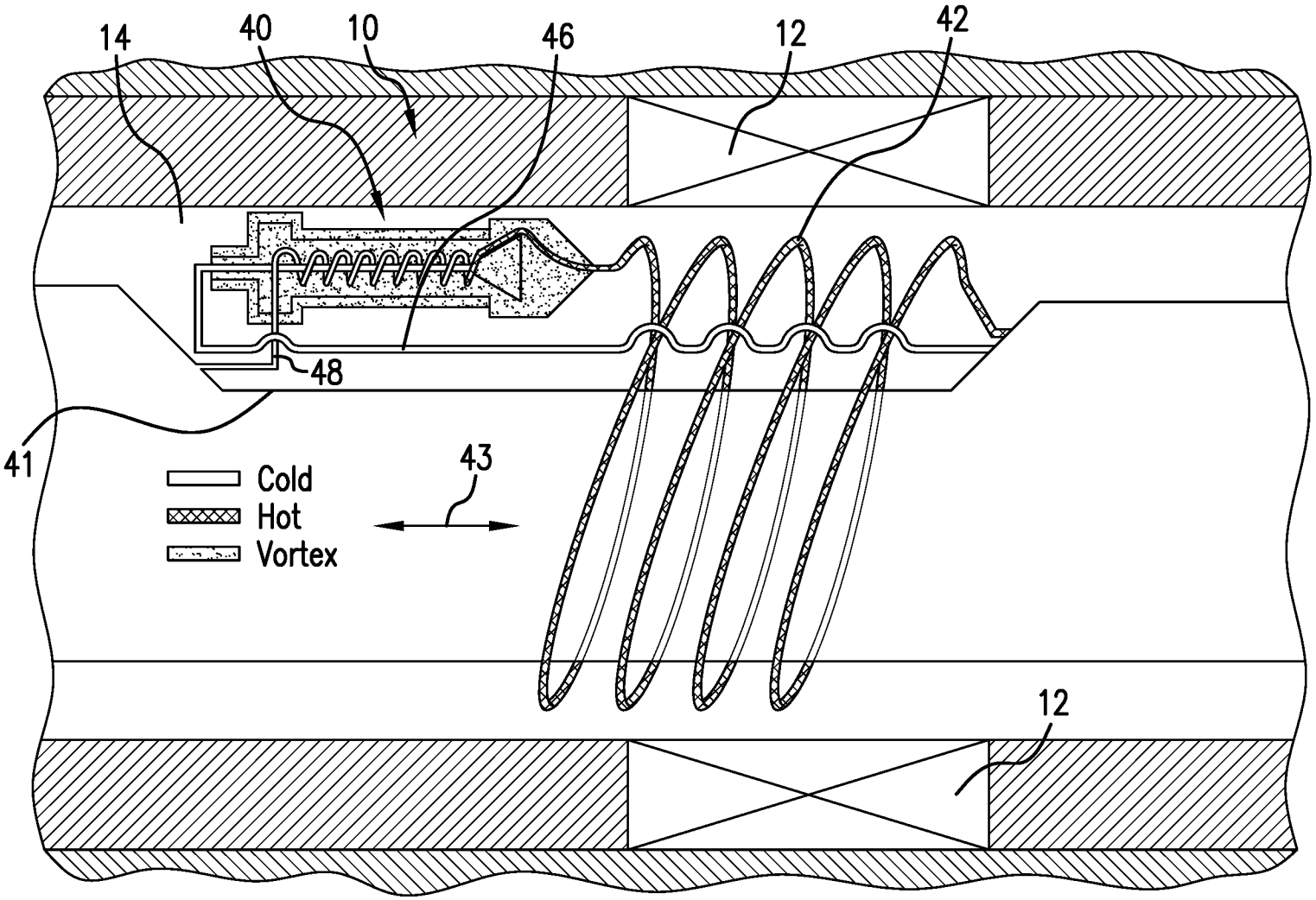
FIG. 11 is a schematic view of a vortex tube embodiment configured to heat the seal tool.
Figure 12:
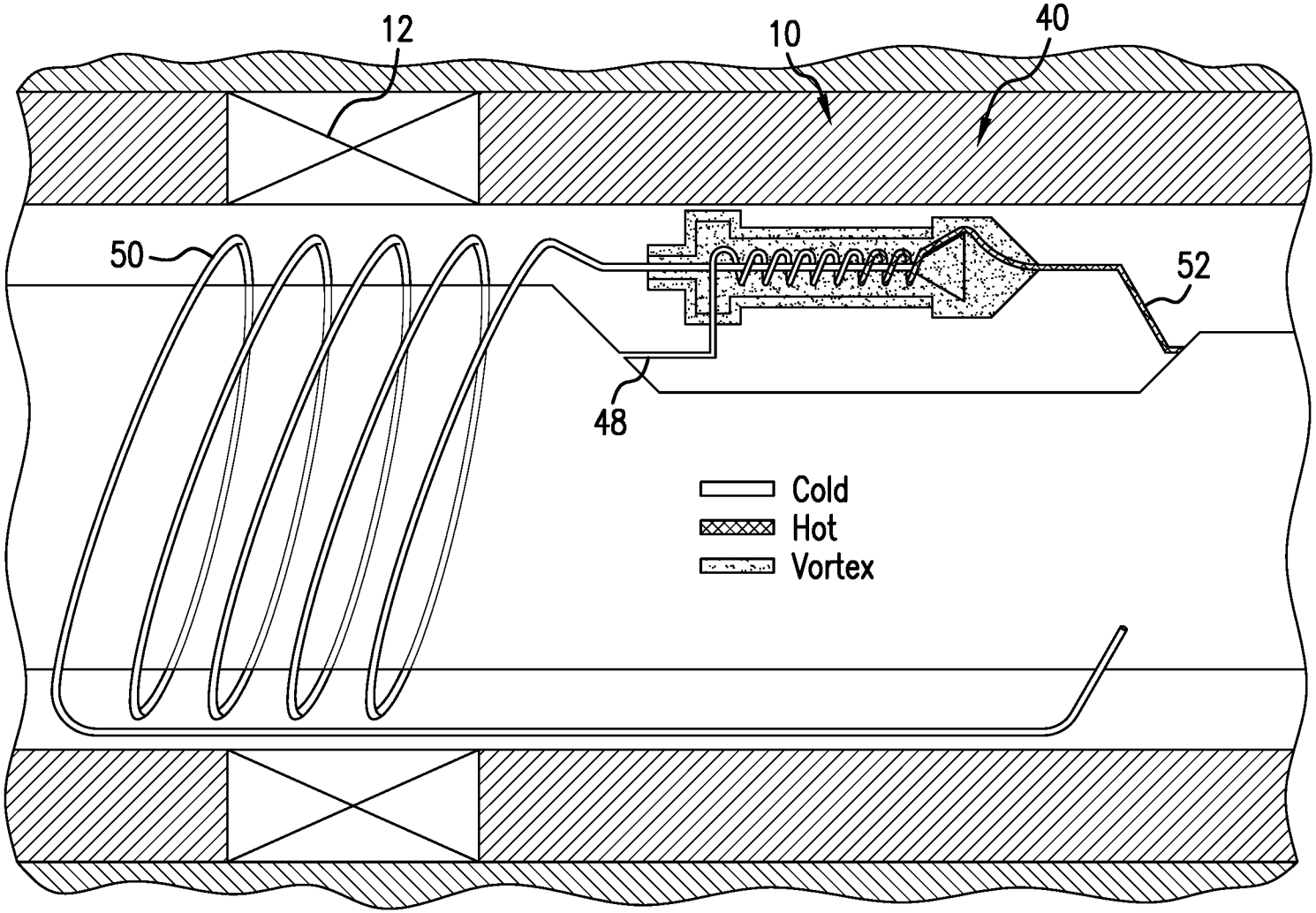
FIG. 12 is a schematic view of a vortex tube embodiment configured to cool the seal tool.

Referring to FIGS. 11 and 12, the temperature controller 30 comprises a Ranque-Hilsch vortex tube 40 or alternatively referred to herein as a vortex device 40 is illustrated within tool 10 to act as the temperature control material. Vortex tubes are well known in their own right. Such tubes accept an input of compressed fluid into a spin chamber. At an end of the tube is a cone that splits the heated flow from the cooled flow. The heated flow exits and the cooled flow rebounds to exit an opposite end of the tube. In the context of the invention, the vortex tube or device 40 is made a part of the tool 10 as disclosed herein. FIG. 11 illustrates a configuration where the seal 12 is heated and FIG. 12 illustrates a configuration where the seal 12 is cooled. In FIG. 11, a hot fluid output path 42 is disposed in thermal communication with the seal 12 to keep seal 12 warm and in the optimal sealing temperature range despite the pumping of fluids that would otherwise cool the seal 12. As illustrated, path 42 is helically disposed in the mandrel 14 of the tool 10, although other path shapes could be substituted where a good thermal efficiency is achieved such as back and forth loops that are circumferentially, perimetrically or longitudinally aligned relative to a longitudinal extent of the tool 10. The cold fluid path 46 from device 40 is routed away from the seal 12. Inlet 48 of the device 40 may be fed by a pump, a control line, etc. as desired where a clean fluid (gas or liquid) is to be supplied to the device 40. Alternatively, wellbore fluid may also be used to supply the device 40. As illustrated, there is a restriction 41 in the inside diameter flow path 43 of the mandrel 14. There also may be in embodiments, a nozzle, an object seat, etc. Any restriction at this location will create a differential pressure thereacross enabling fluid pressure at inlet 48 to be raised, by for example pumps at the surface, to supply the device 40 with a working fluid.

As illustrated in FIG. 12, it is the cold fluid that is used to manage the seal 12. In this case, a cold fluid path 50 is routed to be in thermal communication with the seal 12. As in FIG. 11, the path 50 may be helical or similar (as described above) and restrictions to flow are the same as discussed with regard to FIG. 11. In this embodiment the hot fluid path 52 exits the device 40 in a direction away from the seal 12. This arrangement assists in maintaining the seal 12 in an optimal temperature range despite the pumping of hot fluids.

In either of FIG. 11 or 12, the working fluid, whether that be a clean gas or liquid supplied or a wellbore fluid, may be dumped back to the flow path 43 or may be dumped to an annulus in some embodiments. Also, and particularly in the case of supplied clean fluid, the fluid may be recycled back to a reservoir for that fluid at surface or another location by, for example, connecting control lines to the paths 42/46/50/52 and extending those control lines to the desired destination of the recycled fluid.

Figure 13:
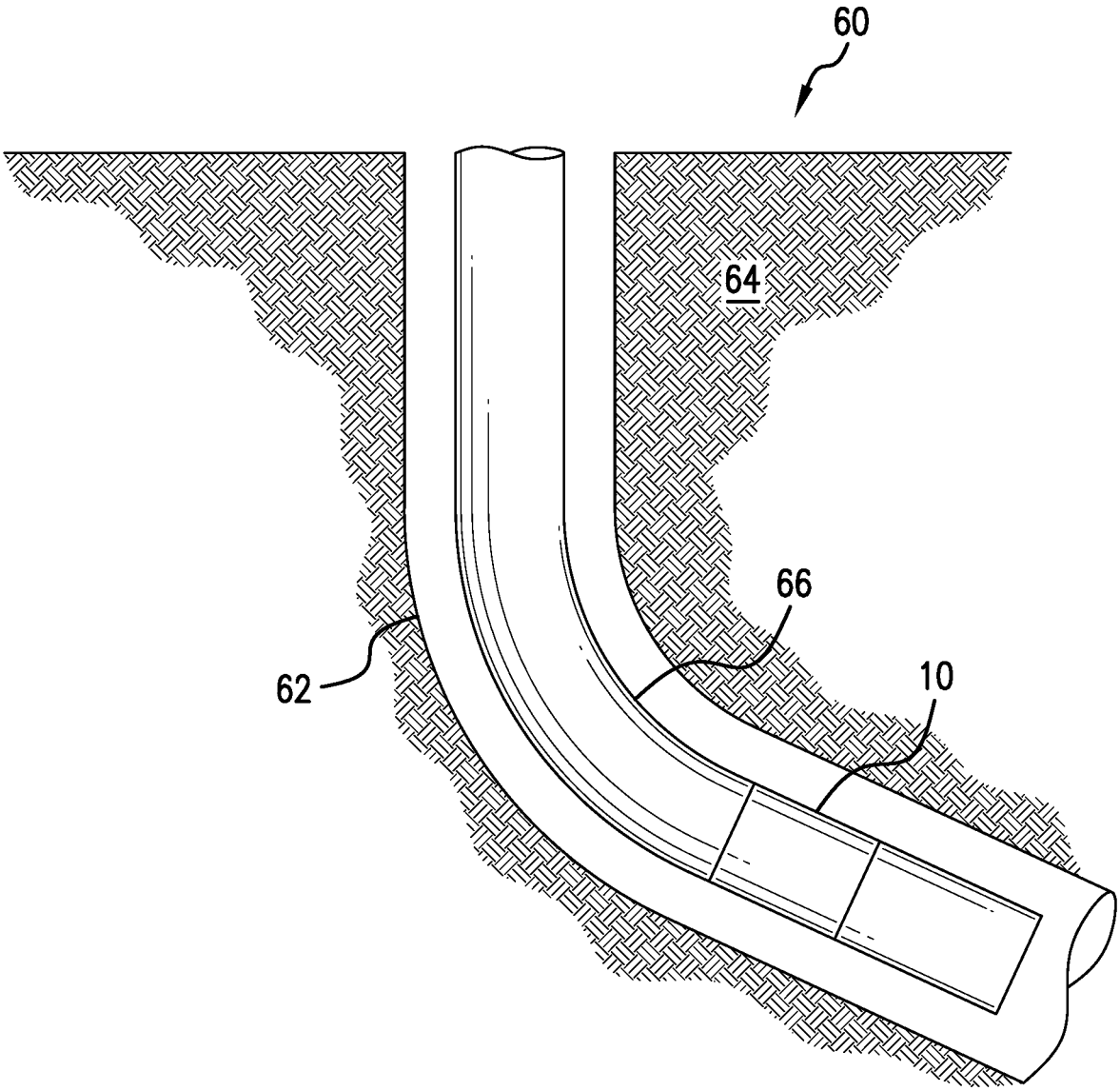
FIG. 13 is a view of a borehole system including temperature control material in thermal communication with a seal as disclosed herein.

Referring to FIG. 13, a borehole system 60 is illustrated. The system 60 comprises a borehole 62 in a subsurface formation 64. A string 66 is disposed within the borehole 62. The seal tool 10 with temperature control material as disclosed herein is disposed within or as a part of the string 66.

Set forth below are some embodiments of the foregoing disclosure:

Embodiment 1: A method for improving sealing in boreholes includes temperature controlling seals to maintain sealing loading by managing temperature of the seal to a target temperature range.

Embodiment 2: The method as in any prior embodiment, wherein the controlling is heating.

Embodiment 3: The method as in any prior embodiment, wherein the controlling is cooling.

Embodiment 4: The method as in any prior embodiment, wherein the controlling is inductive.

Embodiment 5: The method as in any prior embodiment, wherein the controlling is conductive.

Embodiment 6: The method as in any prior embodiment, wherein the controlling is supplying a direct current to a material receptive to the current.

Embodiment 7: The method as in any prior embodiment, further comprising resisting the current and generating heat.

Embodiment 8: The method as in any prior embodiment, wherein the controlling is supplying an alternating current to a material receptive to the current.

Embodiment 9: The method as in any prior embodiment, further comprising generating heat through an inductor.

Embodiment 10: The method as in any prior embodiment, further comprising spreading temperature generated in the temperature controlling using thermally conductive material.

Embodiment 11: The method as in any prior embodiment, wherein the controlling is by thermoelectric device.

Embodiment 12: The method as in any prior embodiment, wherein the controlling is by vortex tube.

Embodiment 13: The method as in any prior embodiment, further comprising supplying compressed gas to the vortex tube.

Embodiment 14: A borehole system includes a borehole in a subsurface formation, a string in the borehole, a seal tool in contact with the string and temperature controller within or in thermal proximity to the seal.

Embodiment 15: The system as in any prior embodiment, wherein the temperature controller is an inductor disposed within the seal.

Embodiment 16: The system as in any prior embodiment, wherein the temperature controller is an inductor disposed adjacent the seal.

Embodiment 17: The system as in any prior embodiment, wherein the temperature controller is electrically resistive.

Embodiment 18: The system as in any prior embodiment, wherein the temperature controller is a chiller disposed within the seal.

Embodiment 19: The system as in any prior embodiment, wherein the temperature controller is a chiller disposed adjacent the seal.

Embodiment 20: The system as in any prior embodiment, wherein the temperature controller is a heater.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method for improving sealing performance of elastomeric seals in boreholes, comprising:

temperature controlling elastomeric seals after setting to maintain sealing loading by managing temperature of the seal to a temperature below ambient in a location where the seal is set.

2. The method as claimed in claim 1, wherein the controlling is conductive.

3. The method as claimed in claim 1, wherein the controlling is supplying a direct current to a material receptive to the current.

4. The method as claimed in claim 1, wherein the controlling is supplying an alternating current to a material receptive to the current.

5. The method as claimed in claim 1, further comprising spreading temperature generated in the temperature controlling using thermally conductive material.

6. The method as claimed in claim 1, wherein the controlling is by thermoelectric device.

7. The method as claimed in claim 1, wherein the controlling is by vortex tube.

8. The method as claimed in claim 7, further comprising supplying compressed gas to the vortex tube.

9. A borehole system comprising:

a borehole in a subsurface formation;

a string in the borehole;

a seal tool in contact with the string; and a vortex tube heater within or in thermal proximity to the seal.

10. The system as claimed in claim 9, wherein the vortex tube heater is disposed adjacent the seal.

* * * * *